US007621504B2

(12) United States Patent
McCallum

(10) Patent No.: US 7,621,504 B2
(45) Date of Patent: Nov. 24, 2009

(54) CRIBBING APPARATUS

(76) Inventor: Craig McCallum, 145 Tuscany Springs Heights NW, Calgary, Alberta (CA) T31 2X8

( * ) Notice: Subject to any disclaimer, the term of this patent is extended or adjusted under 35 U.S.C. 154(b) by 0 days.

(21) Appl. No.: 11/781,836

(22) Filed: Jul. 23, 2007

(65) Prior Publication Data

US 2009/0026427 A1 Jan. 29, 2009

(51) Int. Cl.
*E02C 3/00* (2006.01)

(52) U.S. Cl. ..... 254/88; 254/104; 254/134; 254/DIG. 1

(58) Field of Classification Search ..... 254/8, 254/133 R, 134, 104, DIG. 1; 188/32
See application file for complete search history.

(56) References Cited

U.S. PATENT DOCUMENTS 2,616,650 A * 11/1952 Thompson ..... 248/346.3
3,752,241 A 8/1973 Rogers
D347,821 S 6/1994 Few
5,503,368 A * 4/1996 Torres ..... 254/88
5,575,591 A 11/1996 Vanderklaauw
6,250,432 B1 6/2001 Hageman et al.
6,354,569 B1 3/2002 Gioia
6,439,543 B1 8/2002 Peckham
7,073,777 B2 * 7/2006 Branstetter ..... 254/88
2005/0236607 A1 10/2005 Pasto

OTHER PUBLICATIONS

EMC—Stabilization—American Rescue—http://emc4rescue.com/catalogs/stabilization/american_rescue/it040002.htm.
EMC—Stabilization—American Rescue—http://emc4rescue.com/catalogs/stabilization/american_rescue/it040003.htm.

* cited by examiner

*Primary Examiner*—Lee D Wilson
(74) *Attorney, Agent, or Firm*—Maxcey Law Offices, PLLC; Stephen Lewellyn

(57) ABSTRACT

A cribbing apparatus for stabilizing a post-accident vehicle against unwanted movement of the vehicle during a rescue operation in which a victim trapped in the vehicle is to be extricated from the vehicle including a cribbing block having a two cribbing block portions, one of which is vertically movable with respect to the second in order to fill a space between the vehicle and the ground. The cribbing block includes a stair-stepped upper surface to facilitate the placement of the cribbing beneath vehicles of various ground clearances. The first cribbing block portion is raised to further fill space between the vehicle and the ground on high clearance vehicles, such as SUVs, Trucks and Buses. The structure and operation of the cribbing apparatus eliminates the need to forcefully jam cribbing into place between the vehicle and the ground and eliminates the need to stack cribbing.

7 Claims, 6 Drawing Sheets

CRIBBING APPARATUS

BACKGROUND OF THE INVENTION

1. Field of the Invention

The present invention relates generally to cribbing for stabilizing a post-accident vehicle from unwanted shifting during rescue of a victim trapped in the vehicle, and more particularly, relating to a height adjustable, stair-stepped cribbing for stabilizing a post-accident vehicle from unwanted shifting.

2. Description of the Related Art

Cribbing is routinely used on the scene of a motor vehicle accident to stabilize a vehicle involved in the accident against unwanted movement that could injure rescue personal or a victim trapped in the vehicle. Cribbing is usually in the form of elongated, wooden blocks that are forced into place beneath a vehicle to be stabilized, prior to entry into the vehicle. In order to establish the desired stabilization, it is necessary to fill any voids between the vehicle and the cribbing so as to prevent unwanted movement of the vehicle. In an attempt to close the voids, rescue personal will often jam pieces of cribbing into place. Many times a rescuer will use a mallet or other similar device to hammer in the cribbing to fill the voids. However, this method is not desirable as the jamming or hammering of the cribbing into unwanted voids can increase the risk of the vehicle moving. In the case of high clearance vehicles, such as for example, SUV's, trucks and busses cribbing needs to be stacked many times to span the distance between the ground and the vehicle. Stacked cribbing is more prone to failure due to additional slip surfaces present with each piece of stacked cribbing. Further, contamination at the scene with vehicle fluids increase the danger of the cribbing failing and unwanted vehicle movement.

Placing cribbing to properly stabilize a vehicle is a dangerous and time consuming process. The time spent placing cribbing is valuable time lost for treating and execrating a trapped victim.

SUMMARY OF THE INVENTION

The present invention eliminates the need to force and stack cribbing in place to fill voids between the ground surface and a post-accident vehicle during a cribbing operation to fully stabilize the vehicle, and provides a more versatile and effective cribbing apparatus for stabilizing a vehicle for rescue of a victim trapped in the vehicle.

In general, in one aspect, a cribbing apparatus for stabilizing a post-accident vehicle against unwanted shifting during extrication of a victim trapped in the vehicle is provided. The cribbing apparatus includes a cribbing block having a forward end, a rearward end spaced longitudinally from the forward end, a stair-stepped upper surface, a lower surface space attitudinally from the upper surface, a first side, and a second side spaced laterally from the first side. The cribbing block is split longitudinally into an upper block portion and a lower block portion, wherein the upper block portion is vertically movable between a lowered position and an elevated position above the lower block portion. A means for vertically moving the upper block portion is connected to the upper body portion and the lower body portion and is operable to vertically move the upper block portion.

In general, in another aspect, a cribbing apparatus for stabilizing a post-accident vehicle against unwanted shifting during extrication of a victim trapped in the vehicle is provided. The cribbing apparatus includes a cribbing block having a forward end, a rearward end spaced longitudinally from the forward end, a stair-stepped upper surface, a lower surface space attitudinally from the upper surface, a first side, a second side spaced laterally from the first side, and a longitudinal slot extending through the upper surface. A vertically movable center block portion having a stair-stepped upper surface formed to correspond to the stair-stepped upper surface of the cribbing block is located within the longitudinal slot and being configured to move vertically within the longitudinal slot such that the vertically movable center block portion is positionable between a lowered position where the upper surface thereof is flush with the upper surface of the cribbing block and a raised position where the upper surface thereof is elevated above the upper surface of the cribbing block. A means for vertically moving said vertically movable center block portion is connected to said cribbing block and said vertically movable center block portion, and is operable to vertically move said vertically movable center block portion.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters denote corresponding features consistently throughout the attached drawings.

DETAILED DESCRIPTION OF THE INVENTION

Figure 1:
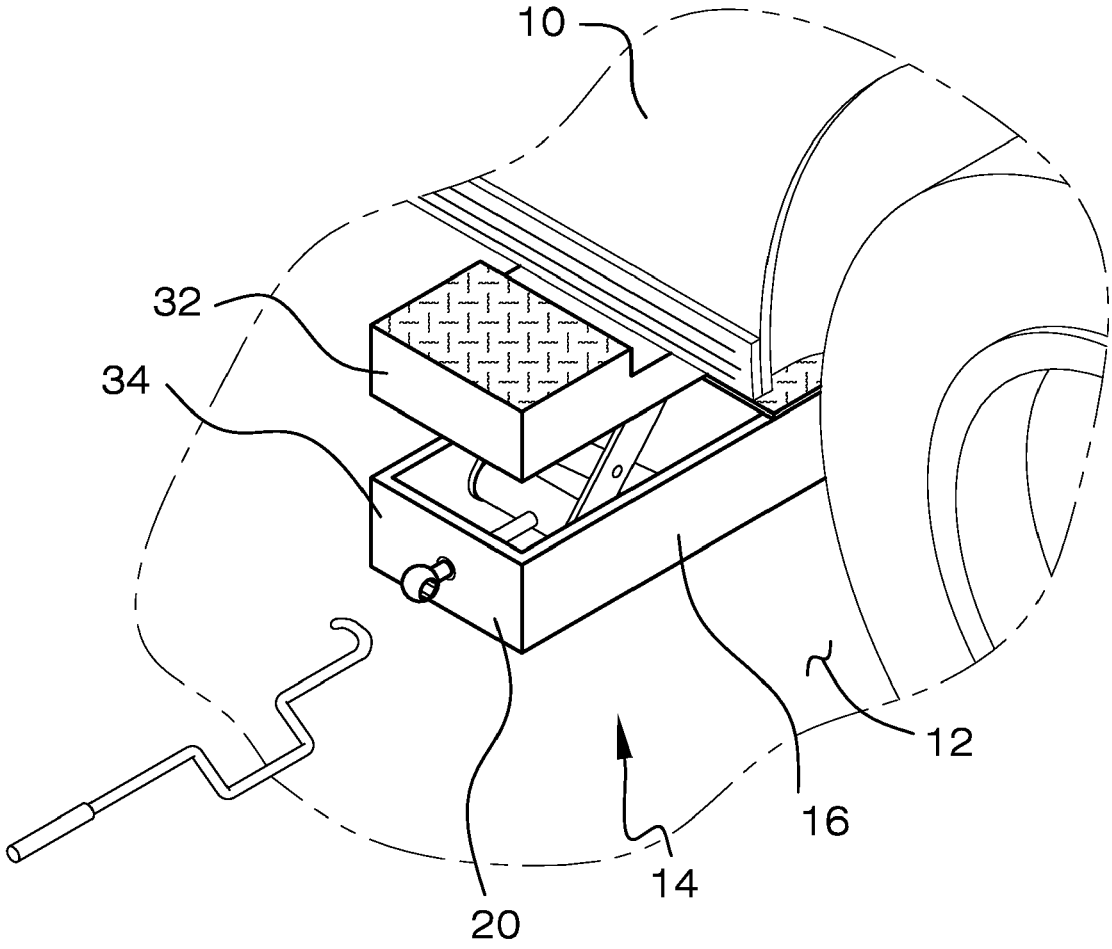
FIG. 1 is a partial pictorial perspective view showing a post-accident vehicle constructed stabilized with the cribbing apparatus constructed in accordance with the principles of the present invention.

In FIG. 1, there is shown a post-accident vehicle 10 stabilized against unwanted movement relative to the ground surface 12 at the scene of an accident which has disabled the vehicle and has trapped a victim (not shown) within the vehicle. The vehicle 10 has been stabilized against unwanted movement, and thus permitting rescuers to enter the vehicle 10 and extricate the victim by the placement beneath the vehicle the cribbing apparatus 14 constructed in accordance with the present invention. The cribbing apparatus 14 is firmly secured between the vehicle 10 and the ground 12, usually at several locations spaced around the vehicle, so as to prevent relative movement between the vehicle and the ground during rescue operations.

Referring now to FIGS. 1-4, in a first configuration, the cribbing apparatus 14 includes a cribbing block 16 having a forward end 18, a rearward end 20 spaced longitudinal from the forward end, an upper surface 22, a bottom surface 24 space attitudinally from the upper surface, a first side 26, and a second side 28 space laterally from the first side. The cribbing block 16 is generally elongated having a length greater than its width. The upper surface 22 is stair-stepped with the steps increasing in elevation in a direction from the forward end 18 to the rearward end 20, and is textured to reduce slipping. Each step portion provides a horizontal support shelf 1-4 for engagement with a portion of a vehicle to be stabilized. While only four steps or shelves are shown, more or less may be used.

Each shelf 1-4 is at a different elevation providing various elevated contact points that can be made between the vehicle and the cribbing block 16, and thus removing the need to stack cribbing to fill in the space between the vehicle 10 and the ground 12.

The cribbing block 16 is longitudinally split into an upper block portion 32 and a lower block portion 34. The upper block portion 32 is configured to be vertically movable such that it can be raised at a spaced elevated distance above the lower block portion 34 in order or fill the space between the vehicle 10 and the ground 12 to stabilize the vehicle, and thus further eliminating the need to stack cribbing and also eliminating the need to force cribbing into place. A means 36 for vertically moving the upper block portion 32 is connected to and intermediately between and to the upper block portion and the lower block portion. The means 36 operates to vertically move the upper block portion 32 from a collapsed, lowered position where a lower surface 38 of the upper block portion is juxtaposed an upper surface 40 of the lower block portion 34 and a raised position where the upper block portion is elevated above the lower block portion.

Figure 2:
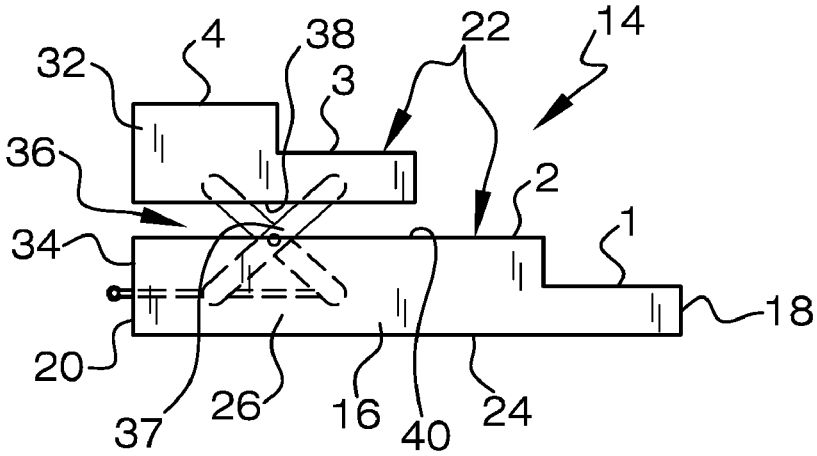
FIG. 2 is a side elevation view of the cribbing apparatus in an erect position with a first means of raising as a scissor jack.

In one example, the means 36 for vertically moving the upper block portion 32 can be a scissor type jack mechanism 37 as shown in FIG. 2 and described in U.S. Pat. No. 6,695,289; U.S. Pat. No. 6,607,181; U.S. Pat. No. 5,364,071 and U.S. Pat. No. 4,585,212, wherein the entire of each is incorporated herein by reference.

Figure 3:
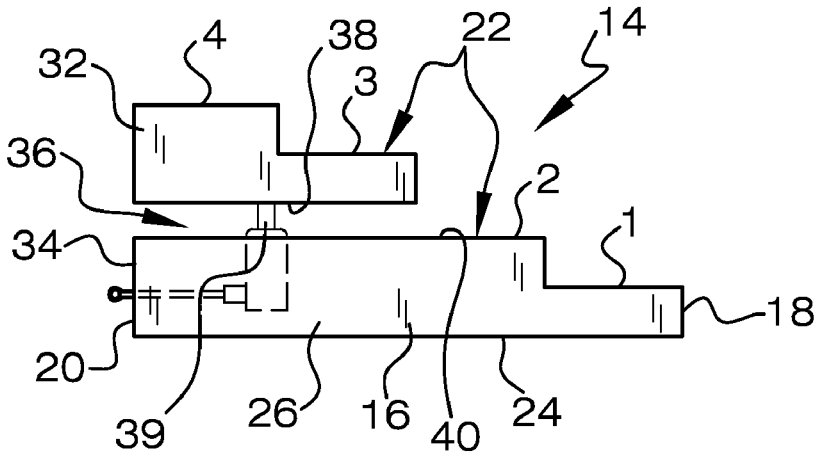
FIG. 3 is a side elevation view of the cribbing apparatus in a erect position with a second means of raising as a hydraulic jack.
Figure 4:
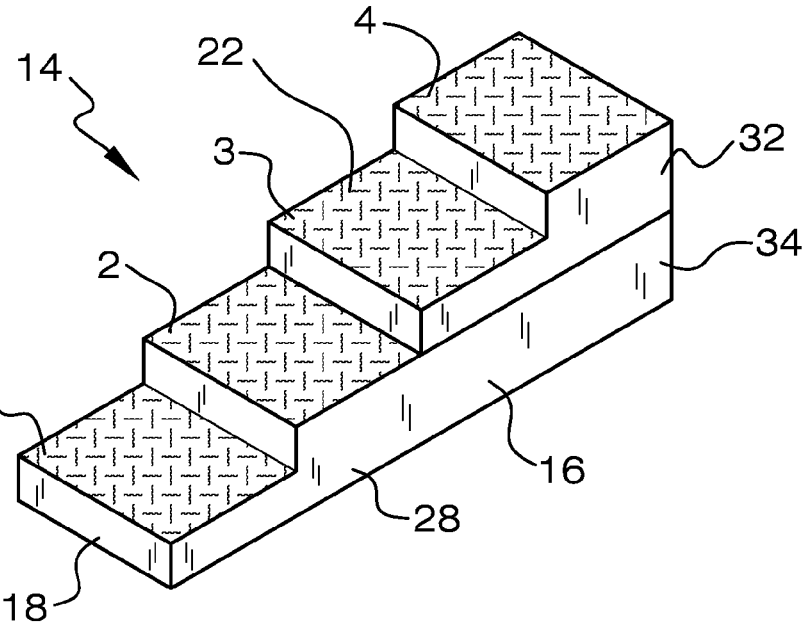
FIG. 4 is a partial front perspective view of the cribbing apparatus.

In an additional example, the means 36 for vertically moving the upper block portion 32 can be a hydraulic cylinder 39, such as a bottle jack mechanism as shown in FIG. 3 and described in U.S. Pat. No. 6,820,861 and U.S. Pat. No. 4,703,916, wherein the entire each is incorporated herein by reference.

Referring now to FIGS. 5-9, there is shown an alternate, second configuration of the cribbing apparatus 14. In this configuration, the cribbing block 16 includes a longitudinal slot 42 through the upper surface 22. The slot 42 extends from the forward end 18 to the rearward end 20 and is centrally located between the first and second sides 26, 28. A center block portion 44 is received by the slot 42 for vertical movement therewithin. The center block portion 44 has a stair-stepped upper surface 46 configured to correspond with the stair-stepped upper surface 22 of the cribbing block 16, a lower surface 48 attitudinally spaced from the upper surface, a forward end 50, a rearward end 52 longitudinally spaced from the forward end, a first side 54, and a second side 56 laterally spaced from the first side. The forward end 50 and rearward end 52 are flush with the forward end 18 and rearward end 20 of the cribbing block 16 respectively.

The center block portion 44 is configured to be vertically moved up and down in the slot 42 from a collapsed, lowered position where the upper surface 46 is flush with the upper surface 22 and a raised position where the upper surface 46 is elevated above the upper surface 22. A means 36' for vertically moving the center block portion 44 is connected to and intermediately between the center block portion and the cribbing block 16. The means 36 operates to vertically move the center block portion from the lowered position where the upper surface 46 is flush with the upper surface 22 and a raised position where the upper surface 46 is elevated above the upper surface 22.

Figure 8:
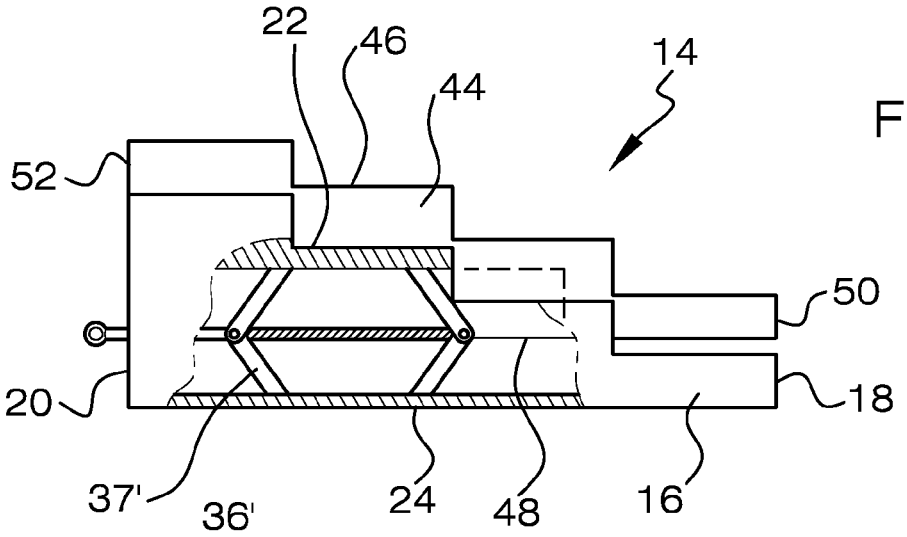
FIG. 8 is a side elevation partial cut-away view of the alternate configuration of the cribbing apparatus shown in FIG. 5 with a first means of raising as a scissor jack.
Figure 9:
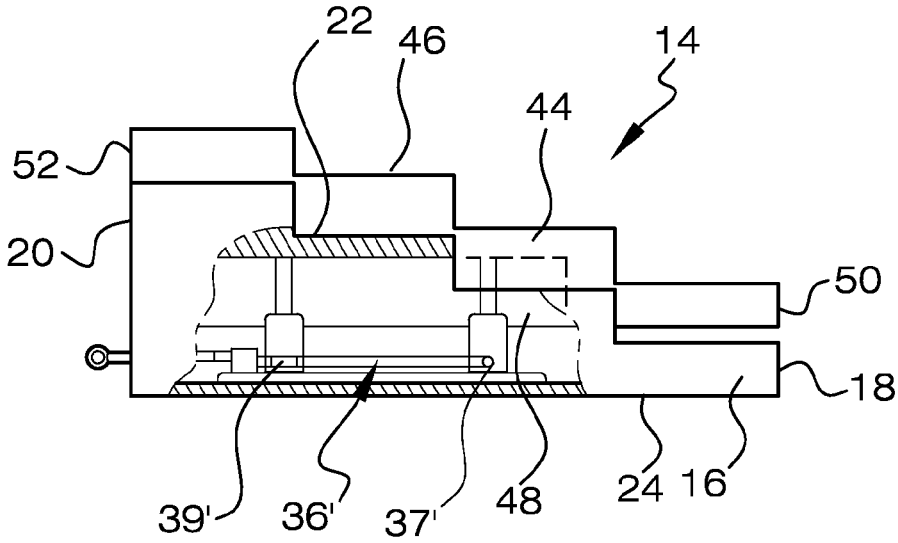
FIG. 9 is a side elevation partial cut-away view of the alternate configuration of the cribbing apparatus shown in FIG. 5 with a second means of raising as a hydraulic jack.

In one example, the means 36' for vertically moving the center block portion 44 can be a scissor type jack mechanism 37' as shown in FIG. 8 and described in U.S. Pat. No. 6,695,289; U.S. Pat. No. 6,607,181; U.S. Pat. No. 5,364,071 and U.S. Pat. No. 4,585,212, wherein the entire of each is incorporated herein by reference.

In an additional example, the means 36' for vertically moving the center block portion 44 can be a hydraulic cylinder 39', such as a bottle jack mechanism as shown in FIG. 3 and described U.S. Pat. No. 6,820,861 and U.S. Pat. No. 4,703,916, wherein the entire each is incorporated herein by reference.

Figure 11:
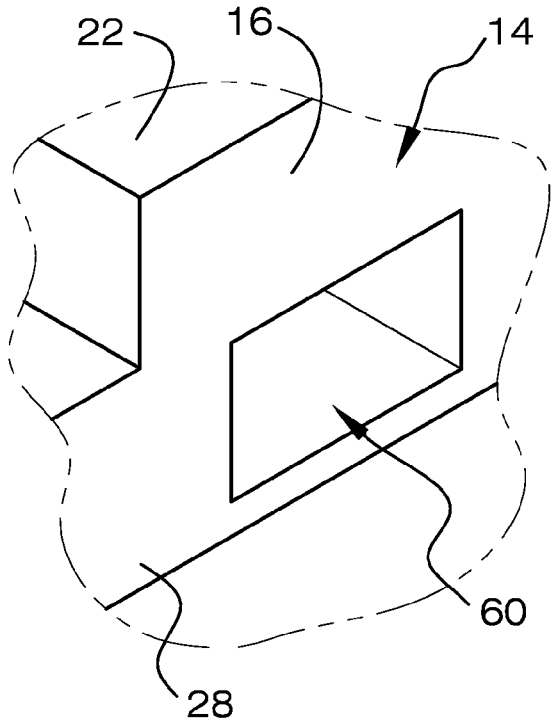
FIG. 11 is a partial perspective view of the alternate configuration of the cribbing apparatus shown in FIG. 10.
Figure 5:
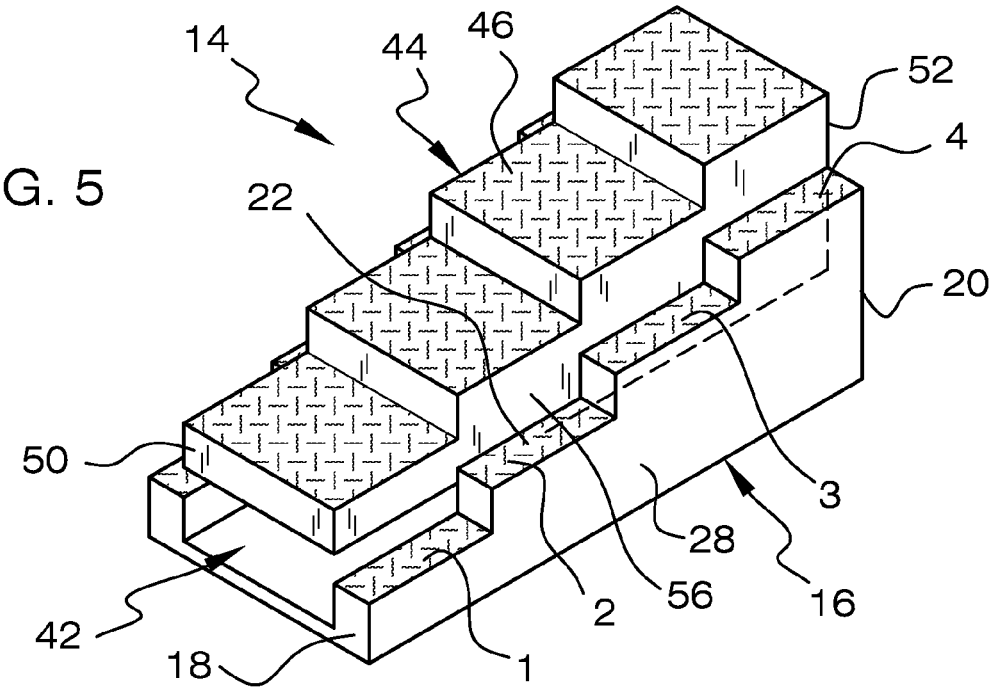
FIG. 5 is a front perspective view of an alternate configuration of the cribbing apparatus.
Figure 6:
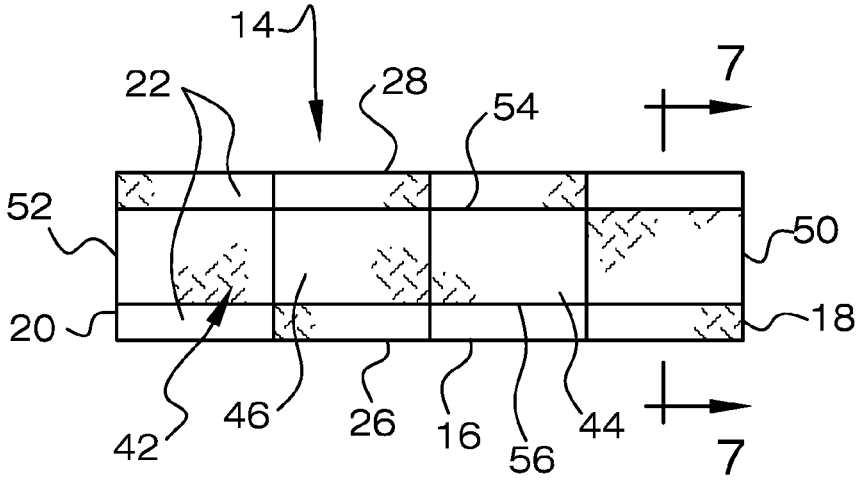
FIG. 6 is a top plan view of the alternate configuration of the cribbing apparatus of FIG. 5.
Figure 7:
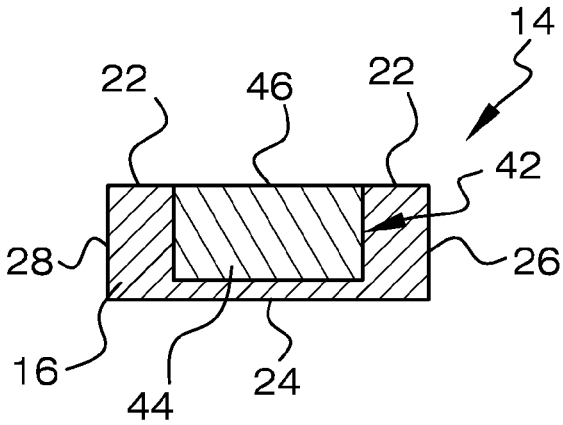
FIG. 7 is a cross sectional view taken along line 7-7 in FIG. 6.
Figure 10:
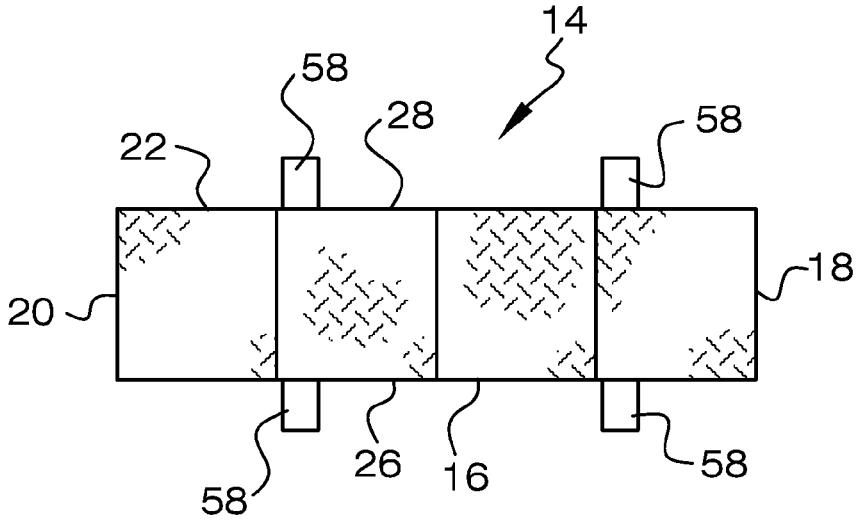
FIG. 10 is a top plan view of an alternate configuration of the cribbing apparatus.

With reference now to FIGS. 10 and 11, an alternate configuration of either the first or the second configuration is shown, where at least one lateral stabilization member 58 extends in a direction generally normal outward from each side 26 and 28. The lateral stabilization member 58 is configured to make contact with the ground at a laterally spaced distance from each side 26, 28 to prevent unwanted lateral movement of the cribbing apparatus 14. The stabilization member 58 can be configured to be removably receivable in a corresponding slot 60 formed through a respective side 26, 28. Preferably, at least two lateral stabilization members 58 are spaced along and extend from each side 26, 28.

Figure 12:
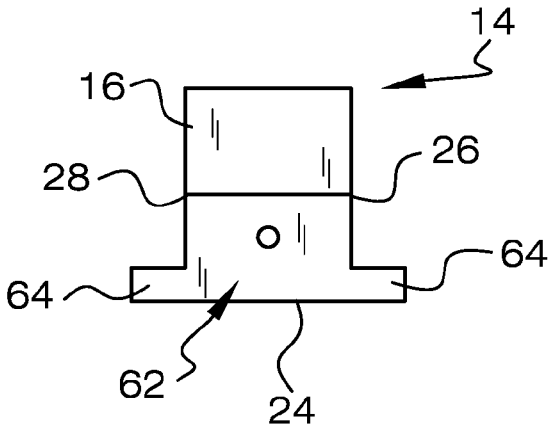
FIG. 12 is a rear elevation view of an alternate configuration of the cribbing apparatus.

With reference now to FIG. 12, an alternate configuration of either the first or the second configuration is shown, where a bottom portion 62 of the cribbing block extends laterally outward from each side 26, 28 forming longitudinal stabilization members 64 to prevent unwanted lateral movement of the cribbing apparatus 14.

In use, the cribbing apparatus 14 of either configuration described above, in the collapsed, lowered position is placed beneath the post-accident vehicle 10 at selected locations chosen by rescue personal for bracing the vehicle from unwanted movement during extrication of the trapped victim. With the cribbing apparatus 14 in the collapsed position, sufficient clearance is available between the cribbing apparatus and the vehicle to place the cribbing apparatus at the desired locations without disturbing the position of the vehicle. Once the cribbing apparatus is placed at the desired location, the means 36, 36' is operated to raise the upper block portion 34 or the center block portion 44 respectively from the lowered collapsed position toward the raised position. In this manner, the space between the post-accident vehicle 10 and the ground 12 at the scene of the accident is filled completely and quickly, and without the need to stack cribbing or forcefully jam cribbing to voids to the fill the space which could disturb the position of the vehicle. This is especially the case in high clearance vehicles such as SUVs, Trucks and buses.

A number of embodiments of the present invention have been described. Nevertheless, it will be understood that various modifications may be made without departing from the spirit and scope of the invention. Accordingly, other embodiments are within the scope of the following claims.

I claim:

1. A cribbing apparatus for stabilizing a post-accident vehicle against unwanted shifting during extrication of a victim trapped in the vehicle, the cribbing apparatus comprising:

a cribbing block having a forward end, a rearward end spaced longitudinally from said forward end, a stair-stepped upper surface, a lower surface space attitudinally from said upper surface, a first side, a second side spaced laterally from said first side, and a longitudinal slot extending through said upper surface between said forward end and said rearward end and centrally between said first and said second sides, said stair-stepped upper surface of said cribbing block providing plurality of horizontal shelves increasing in elevation in a direction from said forward end to said rearward end;

a vertically movable center block portion having a stair-stepped upper surface, said vertically movable center block portion is located within said longitudinal slot and being configured to move vertically within said longitudinal slot such that said vertically movable center block portion is positionable between a lowered position where said upper surface thereof is flush with said upper surface of said cribbing block and a raised position where said upper surface thereof is elevated above said upper surface of said cribbing block; and a means for vertically moving said vertically movable center block portion is connected to said cribbing block and said vertically movable center block portion, and is operable to vertically move said vertically movable center block portion.

2. The cribbing apparatus of claim 1, wherein said lift means is a scissor jack having an upper support end attached to said vertically movable center block portion and a lower base end attached to said cribbing block.

3. The cribbing apparatus of claim 1, wherein said lift means is a hydraulic jack having an upper support end attached to said vertically movable center block portion and a lower base end attached to said cribbing block.

4. The cribbing apparatus of claim 1, wherein said upper surface of said cribbing block and said upper surface of said vertically movable center block portion are textured.

5. The cribbing apparatus of claim 1, further comprising:

a least one lateral stabilization member extending outwardly from said first and said second sides.

6. The cribbing apparatus of claim 5, wherein said at least one lateral stabilization member is removably received by said cribbing block.

7. The cribbing apparatus of claim 1, wherein a bottom portion of each of said first and said second sides extends laterally outward.

* * * * *